US006009603A

United States Patent [19]

Gallagher

[11] Patent Number: 6,009,603

[45] Date of Patent: Jan. 4, 2000

[54] CLOSURE FASTENER STRIPS FOR RESEALABLE PLASTIC FILM POUCHES

[76] Inventor: Stephen F. Gallagher, 100 New State, Raynham, Mass. 02767

[21] Appl. No.: 09/182,821

[22] Filed: Oct. 29, 1998

[51] Int. Cl.[7] ..... B65D 33/00; B65D 77/00

[52] U.S. Cl. ..... 24/587; 24/576; 24/400; 24/399; 383/63

[58] Field of Search ..... 24/587, 576, 400, 24/399, 693; 383/63, 65

[56] References Cited

U.S. PATENT DOCUMENTS

| | | | |
|---|---|---|---|
| 3,338,285 | 8/1967 | Jaster | 24/587 |
| 4,736,451 | 4/1988 | Ausnit | 383/65 |
| 5,211,481 | 5/1993 | Tilman | 24/587 |
| 5,248,201 | 9/1993 | Kettner et al. | 24/587 |
| 5,293,672 | 3/1994 | Tominaga et al. | 24/587 |
| 5,774,955 | 7/1998 | Borchardt et al. | 24/587 |

FOREIGN PATENT DOCUMENTS

| | | | |
|---|---|---|---|
| 2656645 | 6/1978 | Germany | 24/587 |
| 5229565 | 9/1993 | Japan | 24/587 |

*Primary Examiner*—Victor N. Sakran

[57] ABSTRACT

A leak resistant reclosable plastic closure structure with stable interlocking fastener strips particularly suited for resealable and reopenable plastic film pouches or other flexible containers. The closure comprises first and second extruded thermoplastic continuous fastener strips having longitudinally extending engagable profiles having flanges affixed along the opening walls of a pouch forming marginal portions thereon.

The first strip profile having a resilient central arch sealing means flanked by outward locking shoulders and walls that join at right angles to flanges forming a gap spanned by said film completing the exterior of a cavity therein. The second strip profile comprising a base element having a flexible narrow section and an adjacent ridge cooperating sealing member flanked by right angle walls terminating with inward locking hooks, said section bends when said portions are pulled apart providing disengaging means that allows one wall to tilt outward spreading the hooks, thereby disengaging the hooks from the shoulders.

Manually engaging the strips locks the hooks and shoulders together while the second strip ridge displaces the first strip central arch forming a preloaded sealing joint along the length of the closure, said joint and shoulders being in triangular relationship, said film spanning said gap restrains the first strip flanges from spreading apart.

8 Claims, 5 Drawing Sheets

CLOSURE FASTENER STRIPS FOR RESEALABLE PLASTIC FILM POUCHES

BACKGROUND OF THE INVENTION

The present invention relates to reclosable and reopenable thermoplastic film pouch closures and specifically to a structure rendering such a pouch substantially leak resistant. Pouch closures, often referred to as zippers, consist of a pair of extruded thermoplastic strips having longitudinal engagable profiles adapted to be attached along the opening of a pouch forming a marginal portion thereon. The zipper strips are affixed to film stock in the manufacture of plastic bag or pouch flexible containers as disclosed in U.S. Pat. No. 4,698,118. The terms bag and/or pouch are often interchanged in casual speech, however, knowledge of basic differences and purposes of each type is essential to understanding the intended application of the present invention.

Bags are generally constructed of homogeneous heat sealable film stock such as polyethylene or polypropylene where two side walls are fused together at the edges forming a weld approximately 10 times wider than the side wall thicknesses. Zipper strips may be affixed concurrently with extruded film as integral marginal portions of such side walls as disclosed in U.S. Pat. No. 3,462,332. Bags confine goods requiring only moderate protection from ambient conditions such as dust, water droplets and the like. Bags of this construction are less costly to produce than other more complex reclosable flexible containers.

Pouches are generally constructed of composite or barrier film stock where two side wall peripheries are affixed together by one or more of the following methods, i.e. fusing, adhesive bonding, or crimping, which form a face seam seal approximately 100 times wider than the side wall thicknesses. Zipper strips may be affixed to the film stock in preparation of a reclosable plastic pouch such as in U.S. Pat. No. 4,976,811. A pouch protects contents such as food products, pharmacal, chemicals and other substances or goods from deterioration and atmospheric interaction. Pouches of this type are more costly to produce than said bags due to the complexity of the film and the perfection of the face seals needed to provide a higher level of content protection. Zipper strip profiles include interlocking rib and groove elements configured to engage when pressed together in a longitudinal motion and to disengage by pulling the elements in opposite directions at any point along the zipper strips, another form of strip profiles having interlocking clasp and hooked rib elements operates similarly as disclosed in U.S. Pat. No. 4,736,451.

While variations in profile proportions can be seen in the above mentioned forms of plastic bag or pouch zippers, typically such zippers join together with locking elements only, portions or elements exclusively configured to provide a sealing means are not described. A problem exists in that such zipper locking elements when engaged have the appearance of an air tight seal, however contact between the elements is not constant and predictable, and repeated opening and closing of a pouch zipper can cause the locking elements to deform and relax becoming unstable and increasingly less able to hold the strips together tightly, thereby permitting gases or liquids to pass around both strip profiles allowing possible leakage or contamination of the contents within a pouch.

The present invention is unlike the above mentioned prior art, and is distinguishable by the separation of the sealing function from the locking elements thereby providing a distinct sealing means as disclosed herewith.

SUMMARY OF THE INVENTION

It is an object of the present invention to provide a new reclosable plastic closure structure with interlocking fastener strips particularly suited for resealable and reopenable plastic film pouches or other flexible containers. It is a further object of the invention to provide a new leak resistant reclosable plastic closure structure with interlocking fastener strips particularly suited for resealable and reopenable plastic film pouches or other flexible containers. It is a further object of the invention to provide a new leak resistant reclosable plastic closure structure with stable interlocking fastener strips particularly suited for resealable and reopenable plastic film pouches or other flexible containers.

The present invention relates to a plastic closure structure with interlocking fastener strips particularly suited for resealable and reopenable plastic film pouches or other flexible containers. The plastic closure consists of first and second thermoplastic interlocking continuous fastener strips providing opposing cross sectional profiles extending along the length thereof configured to engage and hold tight in sealing contact when the strips are manually pressed together. First and second strips providing flange portions thereon with back surfaces that are affixed to plastic film stock and positioned to be located along the opening of a pouch forming marginal portions thereon. The first and second fastener strips have different cross sectional profiles, but they are similar in that they both include two parallel walls extending from the flanges at right angle and sealing means located between the walls.

The first strip profile comprises a thin central arch having a protruding abutment at each end thereof, each abutment has a wall extending at right angle to the chordal plane of the arch, the walls extend parallel to each other for a distance then turn outward at right angle, forming flange portions separated by a gap between the walls, the flanges having front and back surfaces and ends that define the width of the first strip thereof, the central arch providing sealing means that include an apex and top and bottom sides near together in relation to their length such that the arch is resilient when displaced by a ridge on the opposing second strip profile. The abutments are provided with raised portions extending beyond the apex of the arch top side thereby shielding the top side surface from abrasion, and each abutment has an outward facing locking shoulder configured to interlock with a hook of the opposing second strip profile. The flange back surfaces are to be affixed to the pouch plastic film stock, the film spans the gap between the walls and flanges and completes the exterior of a cavity therein and restrains the flanges from spreading apart.

The second strip profile comprises a rectangular base element having front and back sides and ends, the back side having a recessed portion forming a parallel narrow section within the base and toward the opening of the pouch, the front side including a firm ridge cooperating sealing member adjacent to said narrow section and two parallel walls extending at right angle from the front side spaced apart equidistant from the ridge axis, one wall spaced beyond and adjacent to the narrow section and each wall terminating with an inward locking hook, each hook is configured to interlock and grasp an opposing outward locking shoulder of the first strip and the base element extending beyond the walls providing flange portions thereof, the base ends define the width of the second strip and the back sides of the flanges provide surfaces to be affixed to the pouch plastic film stock.

Manually pressing the walls of the strips together in a longitudinal motion forces the hooks and shoulders to interlock, concurrently the first strip resilient central arch is displaced by the firm ridge of the second strip, thus providing a leak resistant sealing contact force between the strips along the length of the closure. The central arch exerts an opposing force to the ridge bending the adjacent narrow section, causing the walls and hooks to be urged inward against the locking shoulders of the first strip.

The narrow section provides disengaging means, having a length to width ratio such that the section is flexible allowing the base element to bend at the narrow section when the pouch marginal portions are manually pulled apart, thereby spreading the walls while increasing the distance between the locking hooks, unlocking the shoulders and disengaging the fastener strips, thereby allowing the pouch to be opened.

The fastener strips remain securely interlocked should the pouch be internally pressurized by a undetermined means, any force resulting from such a pressure would tighten the sealing contact of the ridge to the arch and tighten the locked hooks and shoulders thus preventing the pouch from opening. In accordance with one aspect of the invention, the means for sealing the fastener strips together being separate and distinct from the means for locking the strips together, the relative position of the sealing means is such that reference planes passing through each locking shoulder and extending through the arch apex intersect each other and describe the sides of an obtuse angle with both sides being of equal length from said shoulders, a triangular form is completed by a third reference plane passing through both shoulders and intersecting said planes passing though the arch apex.

In accordance with another aspect of the invention, the force applied manually to interlock the strips is partially retained elastically within the closure structure thereby providing a preload for the sealing means, said preload is held stable by the interaction of the first and second strips locking means. Hence a new stable reclosable leak resistant pouch closure structure is present. Other objects and advantages of the invention will become apparent from the following detailed description of the invention taken in conjunction with the accompanying drawings.

DETAILED DESCRIPTION OF THE PREFERRED EMBODIMENT

Figure 1:
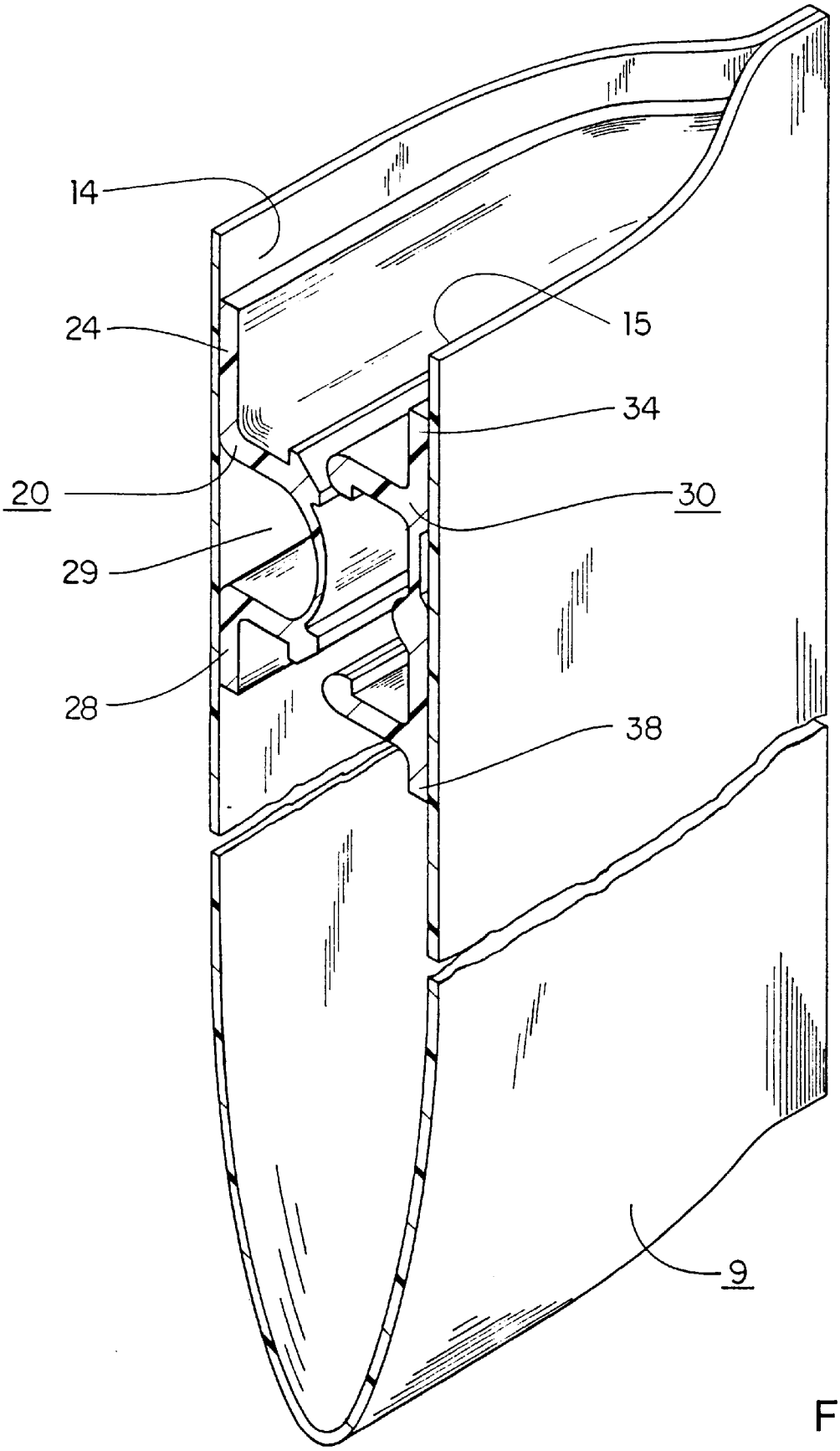
FIG. 1 is a perspective view of a resealable pouch incorporating a closure in accordance with the present invention.
Figure 4:
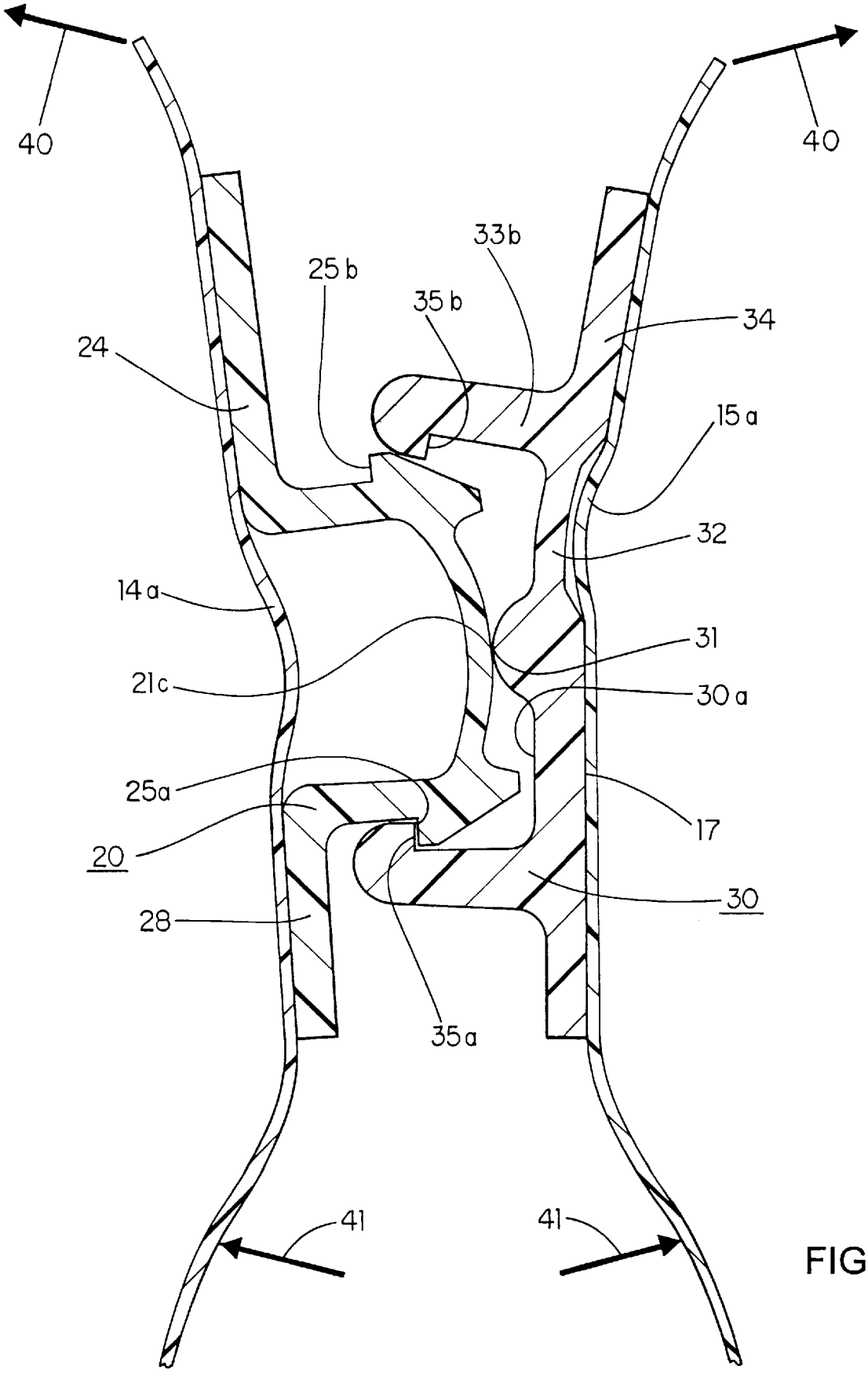
FIG. 4 is a sectional view similar to FIG. 3 of the pouch marginal portions being pulled apart illustrating flexible disengagement of the closure and resistance to pressure applied to the pouch interior walls.

Referring to FIG. 1, there is illustrated a view of a manufactured plastic film pouch 9 with fastener first strip 20 and second strip 30 affixed to the marginal portion interior walls along the opening of said pouch, forming a closure in accordance with the present invention. First strip flanges 24 and 28 are fused to pouch wall 14 forming cavity 29, second strip flanges 34 and 38 are fused to opposing pouch wall 15. Flanges 24 and 34 extend toward the opening of said pouch and are longer than flanges 28 and 38; this difference in length adds stiffness to said pouch marginal portions and provides leverage as manual forces are applied in opposite directions pulling said marginal portions disengaging said closure thus opening said pouch, as can be seen in FIG. 4.

Figure 2:
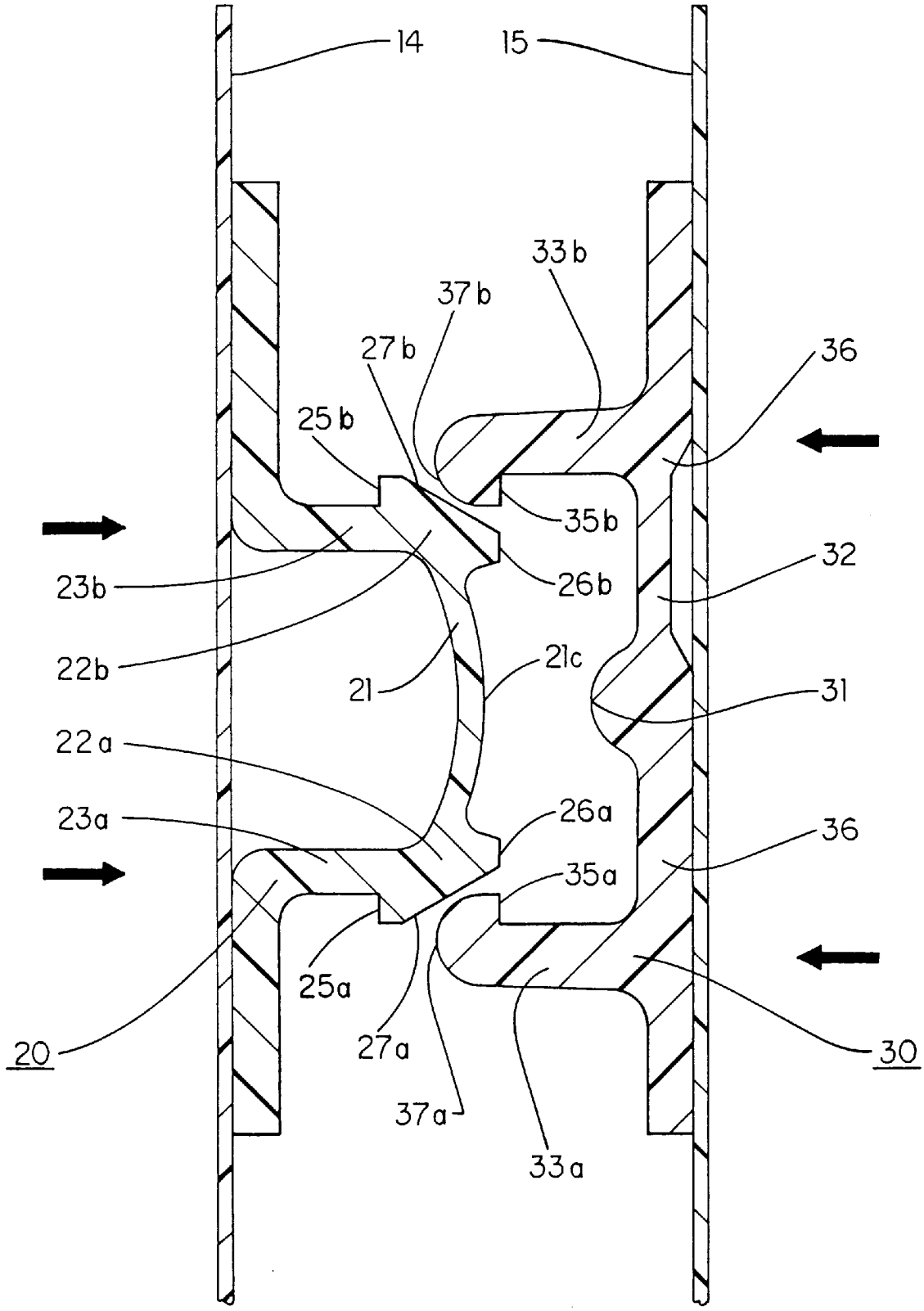
FIG. 2 is a fragmental sectional view of the fastener strips in profile, approaching engagement affixed along a pouch opening

As may be seen in FIG. 2, the preferred embodiment includes first strip 20 having abutments 22*a* and 22*b* with guiding inclined surfaces 27*a* and 27*b* connecting raised portion 26*a* to locking shoulders 25*a* and portion 26*b* to shoulder 25*b*, and second strip 30 having curved surfaces 37*a* and 37*b* adjacent to locking hooks 35*a* and 35*b*. Said pouch is closed by manually pressing said fastener strips together applying force to walls 23*a* and 23*b*, and also to walls 33*a* and 33*b*, thus urging curved surfaces 37*a* and 37*b* to contact inclined surfaces 27*a* and 27*b* at approximately midpoint, bringing the strips into alignment as they are pressed together. Said inclined surfaces act as wedges spreading hooks 35*a* and 35*b* farther apart and bending narrow section 32 as said curved surfaces advance along said inclined surfaces, concurrently, firm ridge cooperating sealing member 31 contacts resilient central arch 21 at the midpoint apex 21*c*, thus initiating sealing contact, further pressing said fastener strips together forces said hooks to snap over shoulders 25*a* and 25*b*, while ridge 31 displaces central arch 21, thus locking the fastener strips tightly together completing said closure, as can be seen in the fully preloaded interlocked position, in FIG. 3.

Figure 3:
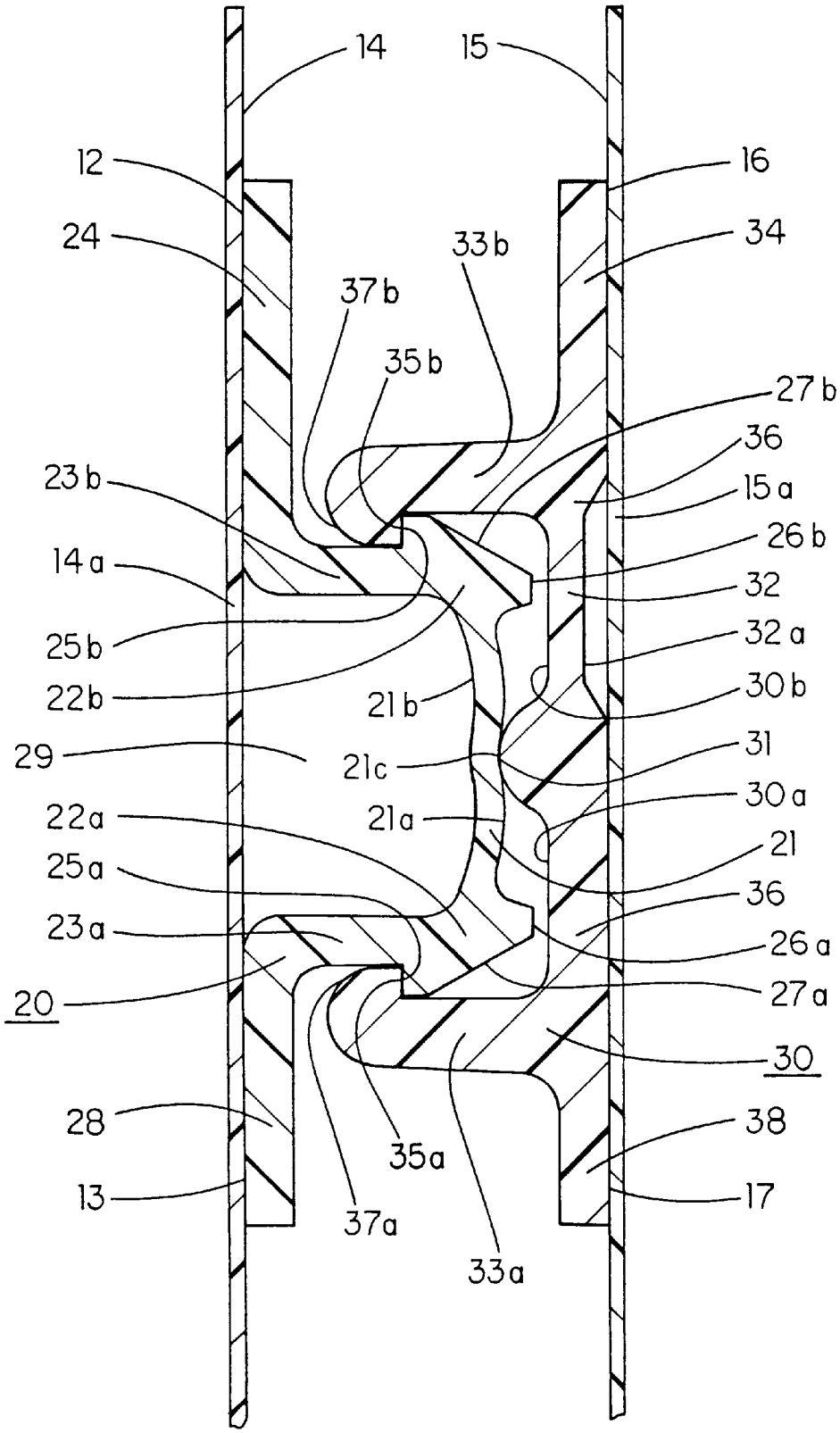
FIG. 3 is a similar view of the fastener strips in the engaged position with the sealing means preloaded.

Referring to FIG. 3, there is illustrated a sectional view of the closure fastener strips in the interlocked position with said sealing means fully preloaded. The closure fastener strips, first 20 and second 30 have continuous longitudinal profiles along their lengths and are expected to be extruded of flexible thermoplastic such as polyethylene resin. Cross sectional thicknesses vary throughout the strip profiles with certain portions configured to be thin and flexible while other portions are thicker and therefore more rigid as described in the following text.

The first strip 20 central arch 21 has a top side 21*a* and bottom side 21*b* near together such that said arch is the thinnest portion of first strip 20 and has a long length of arc relative to the close spacing between said sides, thus allowing said arch to elastically spring back with opposing force as ridge 31 conveys the initial manual load at apex 21*c* forcing arch 21 into cavity 29. This cooperative contact between said arch and ridge forms a preloaded longitudinal sealing joint, retained by said locking means along the length of the engaged fastener strips. The depth of cavity 29 from flange back surfaces 12 and 13 is sufficient to allow clearance for the displacement of arch 21, protruding abutments 22*a* and 22*b* are substantially solid and rigid elements at each end of arch 21, said abutments have raised portions 26*a* and 26*b* extending beyond apex 21*c* sufficient to protect arch top side 21*a* from abrasion damage that might occur during a manufacturing process. The first strip 20 inclined surfaces 27*a* and 27*b* extend from raised portions 26*a* and 26*b* to locking shoulders 25*a* and 25*b* and face outward on the extruded profile. Said locking shoulders project outward from walls 23*a* and 23*b* and have surfaces substantially parallel to flanges 24 and 28 configured to provide ledges to be grasped by locking hooks 35*a* and 35*b* of second strip 30. The first strip 20 walls 23*a* and 23*b* are parallel and extend from abutments 22*a* and 22*b* at right angle to the chordal plane of arch 21, the height of walls 23*a* and 23*b* is sufficient to allow clearance for hooks 35*a* and 35*b* to engage and disengage shoulders 25*a* and 25*b*. Flanges 24 and 28 extend outward from walls 23*a* and 23*b* at right angle and flange 24 is longer than flange 28. The flange back surfaces 12 and 13 are to be fused to pouch wall 14, plastic film segment 14a completes the exterior of cavity 29. First strip 20 walls 23*a* and 23*b* and flanges 24 and 28 are thicker than arch 2 and therefore more rigid. Second strip 30 locking hooks 35*a* and 35*b* provided on the inward surfaces of walls 33*a* and 33*b*, are positioned to be toward the termination of said walls and configured to have transitional lead-in curved surfaces 37*a* and 37*b*, that contact the guiding inclined surfaces 27*a* and 27*b*. The hooks 35*a* and 35*b* are configured to provide ledges substantially parallel to flanges 34 and 38, said ledges of said hooks to be in holding interlocked contact with said ledges of locking shoulders 25*a* and 25*b*, when said strips are fully engaged. The height of walls 33*a* and 33*b* is sufficient to allow clearance between front side surfaces 30*a* and 30*b* and raised portions 26*a* and 26*b* when first and second strips are full engaged.

Ridge 31 positioned equidistant from walls 33*a* and 33*b* extends beyond front side surfaces 30*a* and 30*b* such that said ridge comes in contact with apex 21*c* and displaces arch 21 before strips 20 and 30 are fully engaged. Narrow section 32 is adjacent to ridge 31 and within the rectangular base element 36 of strip 30 toward said pouch opening and having surfaces 30*b* and 32*a* near together such that section 32 is flexible. Narrow section 32 extends from ridge 31 a distance greater than twice that of the distance from surface 30*b* to surface 32*a*. Flange portions 34 and 38 extend at right angle beyond walls 33*a* and 33*b*, whereas flange 34 is longer than flange 38, and flange back surfaces 16 and 17 are to be fused to pouch wall 15. In this view (FIG. 3) of said strips fully engaged, said preload is retained and distributed throughout the structure, said initial load at apex 21*c* exerts a compressional force to abutments 22*a* and 22*b* and is transmitted through walls 23*a* and 23*b* to flanges 24 and 28 causing film segment 14*a* to be subjected to tensile strain while restraining said flanges from spreading apart, said preload is also present within strip 30, forcing narrow section 32 to bend toward ridge 31 while film segment 15*a* is subjected to tensile strain resisting said preload. As section 32 bends, hooks 35*a* and 35*b* are urged inward against locking shoulders 25*a* and 25*b* thereby holding said strip profiles in locked stable engagement with a preloaded separate and distinct sealing joint along the length of said fastener strips rendering said pouch closure substantially leak resistant.

As may be seen in FIG. 4, said pouch marginal portions are pulled manually in opposite directions as indicated by arrows 40 in the course of disengaging fastener strip 20 from strip 30 thus opening said pouch closure. The longer flanges 24 and 34 extend toward the opening end of said pouch, providing leverage to bend narrow section 32 and relieve the strain on film segments 14*a* and 15*a*, while decreasing the gap between flanges 24 and 28. As the opposing manual forces are applied to said marginal portions, section 32 starts to bend away from ridge 31 and wall 33*b* begins to rotate clockwise in this view, thereby allowing hook 35*b* to tilt away from locked contact with shoulder 25*b* as shown, releasing said fastener strips from engagement and thereby allowing said pouch to be opened. Said fastener strips remain securely interlocked in the event said pouch undergoes positive internal pressurization generated within the confines of said pouch by a means undetermined, resultant forces as indicated by arrows 41 of said pressure would urge locking hook 35*a* to strongly grasp locking shoulder 25*a* and would transmit a further load on said preloaded sealing joint at apex 21*c* enhancing leak resistance of said strips, the thicker base element portion between front side 30*a* and back 17 is rigid and able to resist bending and disengagement of said strips, said pouch remains closed should such forces 41 be present.

Figure 5:
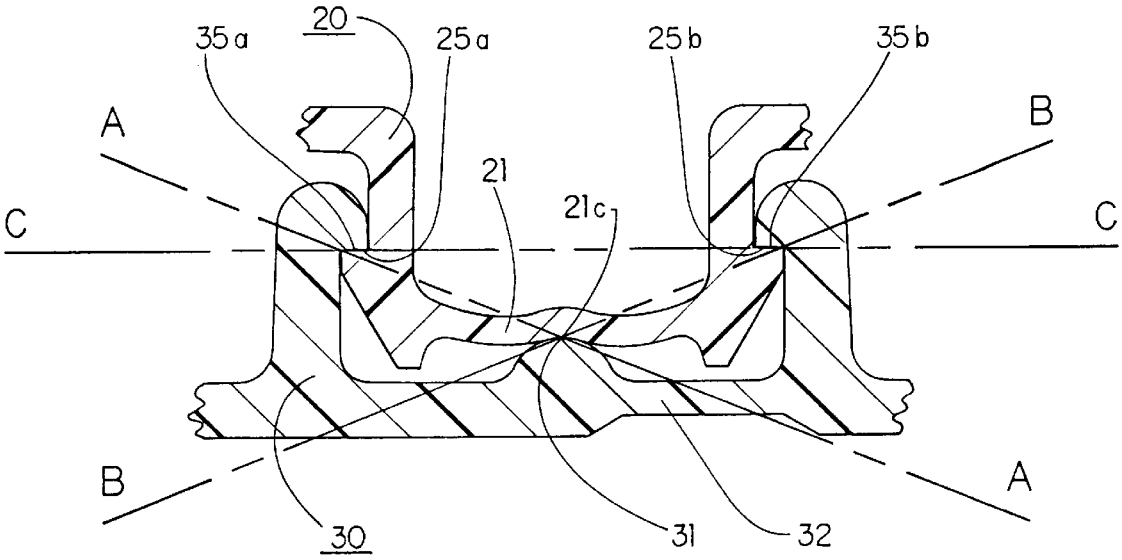
FIG. 5 is a detail view of the fastener strip profiles engaged showing the triangular relationship of the sealing means to the locking means.

Referring to FIG. 5, there is illustrated an detail view showing the triangular relationship represented by broken lines of said sealing joint to said locking means in the engaged position. Line A—A connects the apex 21*c* to locking shoulder 25*a*, line B—B intersects line A—A at the apex 21*c* and connects said apex to the locking shoulder 25*b*, the resulting angle between line A—A and line B—B is greater than 120 degrees and less than 160 degrees. Broken line C—C intersects line A—A at locking shoulder 25*a* and also line B—B at shoulder 25*b*. The form completed by all three said broken lines, connecting apex 21*c* to said locking shoulders and connecting shoulder 25*a* to shoulder 25*b* is an obtuse triangle representing a region in which interactive contact forces are present, thereby preloading said sealing joint between said closure strips and stabilizing the locking engagement of strip 20 to strip 30. The triangular relationship of structural elements of said closure under strained contact as shown in FIG. 5 is similar to that of a toggle joint device in equilibrium, whereas the initial manual force engaging said strips applied to ridge 31 is transmitted at right angles with mechanical advantage to locking shoulders 25*a* and 25*b* and is resisted and retained by locking hooks 35*a* and 35*b* urged inward by the opposing compressional force present causing section 32 to bend, thus a system of forces in a state of equilibrium is achieved.

Figure 6:
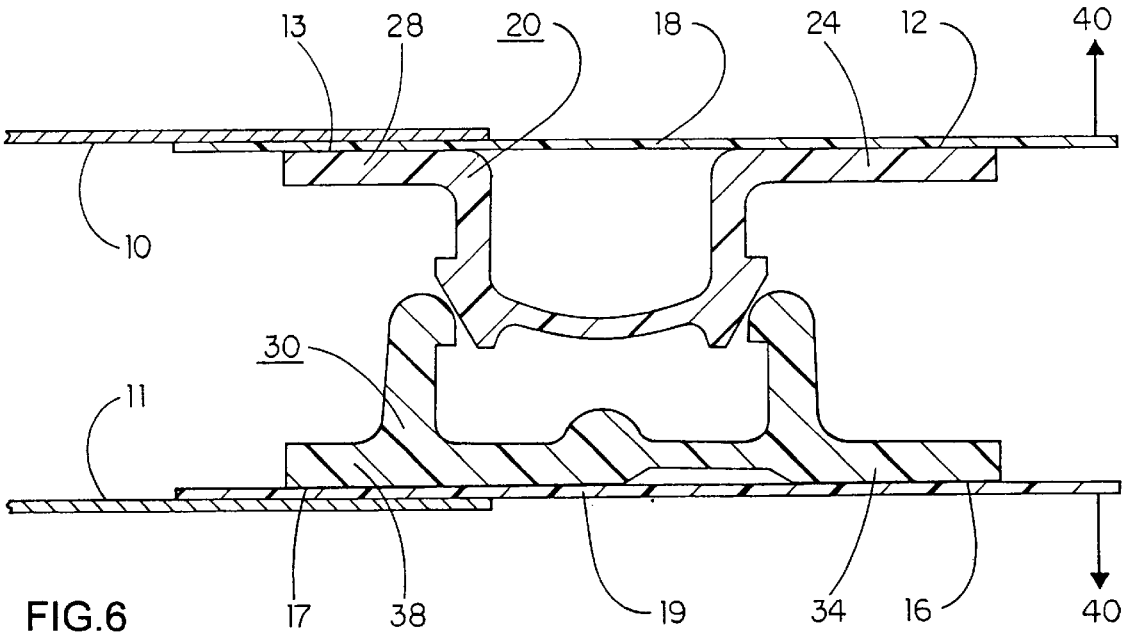
FIG. 6 is a sectional view of the fastener strips fused to intermediate plastic film ribbons then affixed to flexible plastic containers

As may be seen in FIG. 6, a variation in the preferred embodiment of the invention is disclosed showing disengaged closure fastener strips 20 and 30 fused by heat or ultrasonic welding to intermediate plastic film ribbons 18 and 19 and said ribbons affixed to walls 10 and 11 of a container. This adaptation of the invention may be utilized in the manufacture of flexible plastic containers, pouches or bags having a resealable closure in accordance with the present invention when certain container construction requires dissimilar materials be used that would not be compatible when directly heat fused together during the manufacture of such a container. First strip 20 flange back surfaces 12 and 13 are fused to film ribbon 18, second strip 30 flange back surfaces 16 and 17 are fused to film ribbon 19, fused plastic film ribbons 18 and 19 extend beyond the ends of flanges 28 and 38 sufficient to allow proper control of the process used later to affix film ribbon 18 to container wall 10 and also to affix film ribbon 19 to container wall 11, plastic film ribbons 18 and 19 extend beyond the ends of flanges 24 and 34 sufficient to form borders along the opening of said container to which manual forces 40 pulling in opposite directions may be applied to disengage fastener strip 20 from strip 30 thus opening said container. Although the present invention has been described in terms of both a preferred embodiment and one variation, it will be apparent that numerous variations and modifications may be made without departing from the true spirit and scope thereof, as set forth in the following claims:

What is claimed is:

1. A reclosable thermoplastic pouch closure structure comprising first and second fastener strips having longitudinally extending interlockable profiles, second strip having a unidirectional locking means providing damage resistant disengagement of said closure; said fastener strips configured to co-operate when locked to form a central sealing means, said locking means arranged to resiliently preload said sealing means thereby providing leak resistance of said closure; first and second fastener strips include flanges to be affixed along the opening end interior walls of a plastic film pouch or container thereby forming marginal portions thereon;

said first strip profile having a thinnest most portion comprising a thin resilient central arch having an apex sealing surface facing toward said second strip, and rigid protruding abutments at each end of said arch, each said abutment having a wall extending at right angle to the chordal plane of said arch in a direction opposite said apex and said walls extending substantially parallel to each other for a distance then turning outward in opposite directions at right angle thereby forming flange portions separated by a gap, said walls and flanges being thicker and therefore more rigid than said central arch, said flanges having front and back surfaces and ends, said ends defining the width of said first strip, said flange back surfaces to be suitably affixed to said film pouch interior wall, said film pouch wall spans said gap and completes the exterior of a cavity therein, thereby restraining said first strip flanges from outwardly spreading apart; each said abutment includes a raised portion extending beyond said apex, each abutment having an outward facing locking shoulder with a ledge configured to interlock with and be grasped by an inward facing locking hook of said second strip, each said abutment also includes an outward facing guiding inclined surface extending from said raised portion to said shoulder;

said second strip profile comprises a rectangular base element having front and back sides and ends, said base ends defining the width of said second strip; said front side having a central co-operating sealing ridge extending a small distance therefrom, and said side having two parallel walls extending at right angle being spaced apart equidistant from said sealing ridge; said back side having a recessed portion forming a flexible thin rectangular section adjacent to said sealing ridge within said base; said parallel walls being thicker and therefore more rigid than said thin rectangular section, said walls terminating having inward facing locking hooks with ledges configured to interlock with and grasp said outward facing locking shoulders of said first strip, said hooks having transitional lead-in curved surfaces configured to contact said first strip guiding inclined surfaces at approximately midpoint aligning said first and second strips as they are manually pressed into engagement; said base element extending linearly beyond said walls forming flange portions thereof, said flange portions having front and back sides, said flange back sides providing surfaces to be suitably affixed to the opposite interior wall of said film pouch;

wherein said first strip inclined surfaces form an acute angle between said surfaces providing a V-shaped wedge capable of applying a force to said second strip lead-in curved surfaces during engagement, thereby spreading apart said second strip rigid walls with hooks, thus bending said thin rectangular section in a direction away from said ridge; said inclined surfaces and lead-in curved surfaces arranged such that said firm ridge contacts said central arch apex at approximately midpoint initiating sealing contact between said first and second fastener strips before said hooks snap over and grasp said first strip locking shoulders, tightly interlocking said fastener strips together.

2. A closure structure according to claim 1, wherein said second strip central ridge displaces said first strip arch into said cavity sufficient to form a preloaded sealing joint between said fastener strip profiles extending longitudinally along the locked closure length, said joint is located relative to the positions of said shoulders such that reference planes passing through each shoulder and extending through said joint intersect each other, said intersecting planes having an angular relationship to each other that is greater than 120 degrees and less than 160 degrees.

3. A closure structure according to claim 1, wherein said second strip having a section providing a unidirectional disengaging means, said section forming a flexible flat spring-like portion comprised of a thin rectangular cross section proportioned to have a width greater than 200 percent and less than 800 percent of the thickness of said section, thereby enabling said cross section to resiliently bend outwardly and become a curved section in tension when strained by opposing external manual forces pulling said pouch marginal portions apart, said bend allowing said adjacent wall with hook to tilt outwardly in a curved path, clear from locked contact with the opposing first strip locking shoulder.

4. A closure structure according to claim 1, wherein said second strip base element having a thickest most portion providing a means of preventing bi-directional disengagement of said fastener strips, said portion located adjacent to said ridge and opposite said thin rectangular section, said portion also being substantially thicker than said thin rectangular section such that said portion rigidly resists bending when strained by internal forces being applied to said film wall surfaces adjacent to said closure and opposite said opening end of said pouch tending to disengage said fastener strips.

5. A reclosable flexible container closure structure comprising first and second fastener strips having flanges fused to integral intermediate first and second plastic film ribbons, said ribbons providing an interface between said closure fastener strips and a flexible container of incompatible material, said ribbons comprise thin flat thermoplastic continuous strips having front and back sides and edges, said sides extending beyond said fastener strips flanges forming marginal portions thereon, said film ribbon marginal portions to be positioned and affixed along the walls toward the opening end of said flexible container; said first and second strips having longitudinally extending interlockable profiles; said second strip having a unidirectional locking means providing damage resistant disengagement of said closure; said fastener strips configured to co-operate when locked to form a central sealing means, said locking means arranged to resiliently preload said sealing means thereby providing leak resistance of said closure;

said first strip profile having a thinnest most portion comprising a thin resilient central arch having an apex sealing surface facing toward said second strip, and rigid abutments at each end of said arch, each said abutment having a wall extending at right angle to the chordal plane of said arch in a direction opposite said apex and said walls extending substantially parallel to each other for a distance then turning outward in opposite directions at right angle thereby forming flange portions separated by a gap, said walls and flanges being thicker and therefore more rigid than said central arch; said flanges having front and back surfaces and ends, said ends defining the width of said first strip, said flange back surfaces fused to one side of said first ribbon, said first ribbon spans said gap forming a cavity therein, said ribbon configured to restrain said first strip flanges from outwardly spreading apart; each said abutment includes a raised portion extending beyond said apex, each said abutment having an outward facing locking shoulder with a ledge configured to interlock with and be grasped by an inward facing locking hook of said second strip, each said abutment also including an outward facing guiding inclined surface extending from said raised portion to said shoulder; said second strip profile comprises a rectangular base element having front and back sides and ends, said base ends defining the width of said second strip, said front side having a central co-operating sealing ridge extending a small distance therefrom, and said side having two parallel walls extending therefrom at right angle and spaced apart equidistant from said sealing ridge; said back side having a recessed portion forming a flexible thin rectangular section adjacent to said sealing ridge within said base; said walls being thicker and therefore more rigid than said thin rectangular section, said walls terminating having inward facing locking hooks with ledges configured to interlock with and grasp said outward facing locking shoulders of said first strip, said hooks having transitional lead-in curved surfaces configured to contact said first strip guiding inclined surfaces at approximately midpoint aligning said first and second strips as they are manually pressed into engagement; second strip base element extending linearly beyond said walls forming flange portions thereof, said flange portions having front and back sides, said back sides fused to one side of said second ribbon, one margin of said second ribbon is to be affixed to said opposite side wall of said container, so to orient said second strip thin rectangular section toward the container opening end;

wherein said first strip inclined surfaces form an acute angle between said surfaces providing a V-shaped wedge capable of applying a force to said second strip lead-in curved surfaces during engagement, thereby spreading apart said second strip rigid walls with hooks, thus bending said thin rectangular section in a direction away from said ridge; said inclined surfaces and lead-in curved surfaces arranged such that said ridge contacts said central arch at approximately midpoint initiating sealing contact between said first and second fastener strips before said hooks snap over and grasp said locking shoulders, tightly interlocking said fastener strips together.

6. A closure structure according to claim 5, wherein said second strip central ridge displaces said first strip arch into said cavity sufficient to form a preloaded sealing joint between said fastener strip profiles extending longitudinally along the locked closure length, said joint is located relative to the positions of said shoulders such that reference planes passing through each shoulder and extending through said joint intersect each other, said intersecting planes having an angular relationship to each other that is greater than 120 degrees and less than 160 degrees.

7. A closure structure according to claim 5, wherein said second strip having a section providing a unidirectional disengaging means, said section forming a flexible flat spring-like portion comprised of a thin rectangular cross section proportioned to have a width greater than 200 percent and less than 800 percent the thickness of said section, thereby enabling said cross section to resiliently bend outwardly and become a curved section in tension when strained by opposing external manual forces pulling said container opening borders apart, said bend allowing said adjacent wall with hook to tilt outwardly in a curved path, clear from locked contact with the opposing first strip locking shoulder.

8. A closure structure according to claim 5, wherein said second strip base element having a thickest most portion providing a means of preventing bi-directional disengagement of said fastener strips, said portion located adjacent to said ridge and opposite said thin rectangular section, said portion being substantially thicker than said thin rectangular section such that said portion rigidly resists bending when strained by internal forces being applied within said container walls, tending to disengage said closure fastener strips.

* * * * *